United States Patent [19]

Kuo

[11] Patent Number: 4,706,013

[45] Date of Patent: Nov. 10, 1987

[54] MATCHING CURRENT SOURCE

[75] Inventor: Tai-Haur Kuo, Tainan Hsien, Taiwan

[73] Assignee: Industrial Technology Research Institute, Hsinchu, Taiwan

[21] Appl. No.: 932,933

[22] Filed: Nov. 20, 1986

[51] Int. Cl.[4] ..... G05F 3/20

[52] U.S. Cl. ..... 323/316; 323/317

[58] Field of Search ..... 323/315, 316, 317, 350, 323/351, 268, 271

[56] References Cited

U.S. PATENT DOCUMENTS 4,185,236 1/1980 van de Plassche et al. ..... 323/316

4,186,437 1/1980 Cuk ..... 363/316 X

FOREIGN PATENT DOCUMENTS 0080715 5/1983 Japan ..... 323/315

*Primary Examiner*—Patrick R. Salce

*Assistant Examiner*—Kristine Peckman

*Attorney, Agent, or Firm*—Bert J. Lewen; Henry Sternberg

[57] ABSTRACT

In a matching current source for providing equivalent sink and source current, external voltage controls the amplitude of sink current and an operational amplifier is connected to mirror the sink current to the source current. The operational amplifier comprises a unity gain feedback loop for eliminating the effect of the channel length modulation effect in MOS transistors and the Early Effect in bipolar transistors, and serves the function of generating equivalent sink and source currents.

12 Claims, 5 Drawing Figures

MATCHING CURRENT SOURCE

BACKGROUND OF THE INVENTION

1. Field of the Invention

This invention relates to current sources and is more in particular directed to a matching current source for providing the same quantity of sink current as source current.

2. Description of the Prior Art

In many integrated circuits, particularly analog circuits, current sources are frequently used. For some cases, a matching current source which generates equivalent sink and source current is very important. However, it is recognized that the transistor current is affected by the channel length modulation effect in MOS devices and Early Effect in bipolar devices. The drain currents of MOS transistors are consequently not independent of their drain-source voltages and the collector currents of bipolar transistors are not independent of their collector-emitter voltages. Actually, the drain current (collector current) increases with increasing drain-source voltage (collector-emitter voltage).

FIG. 1 illustrates the circuit of a known current source which provides sink current and source current. In this circuit, MOS transistors T1 and T2 are serially connected, with the sources of the transistors T1 and T2 being connected to the voltage terminal V+ and V− respectively and the gate of transistor T1 being connected to its drain at node F. Node F is also coupled to the gate of transistor T3 having its source connected to the terminal V+. Input voltages at node B are applied to the gate of transistor T2 as well as to the gate of a transistor T4 that has its source connected to the voltage terminal V−. A voltage node A controls a switch S, for selectively connecting output node C to the drains of the transistors T3 and T4, at terminals D and E respectively.

Since the channel length modulation effect exists, this circuit can't provide equivalent sink and source current. Node B controls the amplitude of source current. Node C is an output node which is at a fixed voltage in the range between V+ and V−. When node A controls the switch S to close the contact between C and D and open the contact between C and E, this circuit functions to source current. Changes in the voltage applied to node B change the current I1. The drain-source voltage Vds1 of transistor T1 and drain-source voltage Vds2 of transistor T2 vary in opposite directions with changes in the voltage of node B. However, the voltage of node C is constant. Therefore, Vds1–Vds2, Vds1–Vds3 and Vds2–Vds4 vary with changes in the voltage of node B. Vds1, Vds2, Vds3 and Vds4 are the drain-source voltages of transistors T1, T2, T3 and T4 respectively. Not only transistors T1 and T2, but also transistors T3 and T4, experience the different degree of channel length modulation effect. A linear relationship consequently does not exist between currents I1, and I2, and a linear relationship does not exist between currents I3 and I1. Similarly a linear relation does not exist between currents I2 and I3. Moreover, the ratios of current I4(=I2) in the sourcing current mode and the current −I4(=I3) in the sinking current mode are different for different voltages at node B. Therefore, this circuit can's provide matched current. In a matched current condition the amplitude of source current in a sourcing current mode is the same as the amplitude of sink current in sinking current mode, independently of whether those currents are large or small.

One method commonly employed to overcome this problem is the adjustment of the current source by laser trimming. However, this method only provides equivalent source and sink current at one constant current, and the ratio of source-to-sink current varies with different amplitudes of source and sink current.

SUMMARY OF THE INVENTION

A matching current source may be implemented by MOS transistors or bipolar transistors. In spite of the effects of the channel length modulation effect or the Early Effect, the circuit of the invention provides equivalent sink and source current independently of whether the output currents are large or small.

Briefly stated, in accordance with the invention, a matching current source comprises a first stage of a series connected first transistor, a pair of constantly on switches and a second transistor in that order, and a second stage of a series connected third transistor, a pair of current switches, and a fourth transistor in that order. An operational amplifier has a noninverting input coupled to the junction of the constantly on switches, and an output coupled to control the first and third transistors. The third and fourth switches are connected to control the sourcing or sinking mode of operation, and their junction is held at substantially the same potential as the inverting input of the operational amplifier.

An output feedback circuit or integrator may be coupled to the junction of third and forth switches.

DETAILED DISCLOSURE OF THE INVENTION

Figure 2:
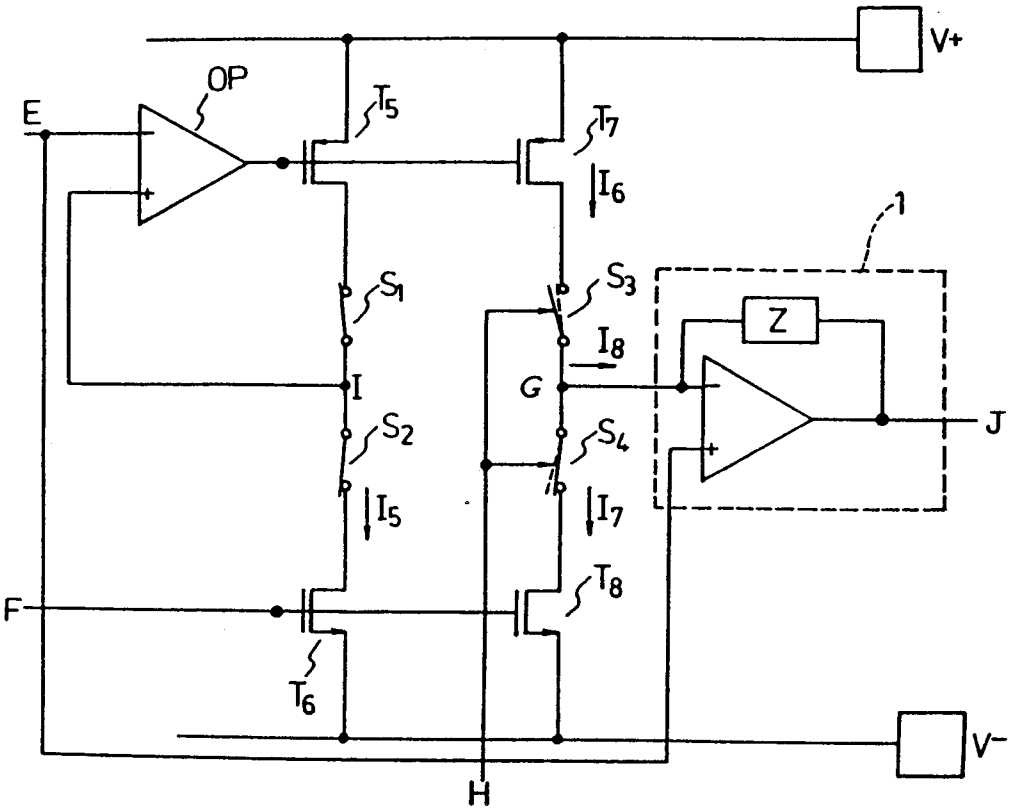
FIG. 2 is a simplified schematic diagram of the current source of the present invention.

A schematic diagram of matching current source of the present invention is illustrated in FIG. 2. As illustrated in this figure, a matching current source is comprised of two dummy switches (S1,S2), two current switches (S3, S4), four current mirror transistors (T5, T6, T7 and T8) and an operational amplifier OP.

As illustrated in FIG. 2, The transistor T5, switches S1 and S2 and transistor T6 are connected in series in that order between the supply voltage terminals V+ and V−, and the transistor T7, switches S3 and S4 and transistor T8 are connected in series in that order between the terminals V+ and V−. The non-inverting input of the amplifier OP is connected to the node I between the switches S1 and S2 and the output of the amplifier is coupled to the gates of the transistors T5 and T7. The switches S3 and S4 are controlled by the voltage at node H. The voltage at node F is applied to the gates of the transistors T6 and T8. The node G, at the junction of switches S3 and S4 is connected to the inverting input of an operational amplifier in the feedback circuit 1 and the voltage at node E is applied to the inverting input of the operational amplifier OP as well as to the non-inverting input of the operational amplifier in the feedback circuit 1. As illustrated in FIG. 2, the feedback circuit may be comprised of the above discussed operational amplifier having a feedback impedance Z, the output terminal J of the feedback circuit having a voltage waveform that is symmetrical in both the sourcing and sinking modes with respect to the voltage V(E) applied to the node E.

Current switches S3 and S4, which are controlled by node H, must have one of the two following conditions:

(i) S3 is on (conductive) and S4 is off (nonconductive) when the matching current source operates in the sourcing current mode.

(ii) S3 is off and S4 is on when the matching current source operates in the sinking current mode.

Switches S1 and S2 provide a constant impedance relationship between the first circuit stage (including transistor T5, switch S1, switch S2 and transistor T6 in series) and the second circuit stage (including transistor T7, switch S3, switch S4 and transistor T8 in series). The switches S1 and S2 are dummy switches since they are constantly on and their sole purpose is to provide an impedance similar to that of a current switch. The voltage applied to node F, coupled to the gates of transistors T6 and T8, controls the amplitudes of the currents I5, I6 and I7. The inverting input, node E, of operational amplifier OP is set at a constant voltage. The output node G of the matching current source is indirectly set at the same voltage as node E by the feedback circuit 1 of FIG. 2. Operational amplifier OP and the first circuit stage comprise a unity gain feedback loop, and therefore nodes E, I and G are held at the same voltage. If the condition:

$$\frac{(W/L)\text{ of }T7}{(W/L)\text{ of }T5} = \frac{(W/L)\text{ of }T8}{(W/L)\text{ of }T6} = \frac{\text{Impedance of }S1}{\text{Impedance of }S3} = \frac{\text{Impedance of }S2}{\text{Impedance of }S4} = X$$

(where L is the channel length of the MOS transistors employed in the circuit, W is channel width of the MOS transistors and X is positive real number) is satisfied, the following conditions will be true:

(i) I8=I6=X*I5 is true since Vgs5=Vgs7, Vds5=Vds7 and (W/L) of $T7=X^*(W/L)$ of T5 when S3 is on and S4 is off.

(ii) −I9=I7=X*I5 is true since Vgs6=Vgs8, Vds6=Vds8 and (W/L) of $T8=X^*(W/L)$ of T6 when S3 is off and S4 is on.

Therefore, the matching current source provides equivalent source and sink current.

If, in a modification of the circuit shown in FIG. 2, the transistors T5, T6, T7 and T8 are bipolar transistors and the condition:

$$\frac{\text{size of }T7}{\text{size of }T5} = \frac{\text{size of }T8}{\text{size of }T6} = \frac{\text{Impedance of }S1}{\text{Impedance of }S3} = \frac{\text{Impedance of }S2}{\text{Impedance of }S4} = X$$

is satisfied, the matching current source also provides equivalent source and sink current since Vbe5=Vfbe7, Vce5=Vce7 when S3 is on and S4 is off and Vbe6=-Vbe8, Vce6=Vce8 when S3 is off and S4 is on. This is analogous to the matching current source employing MOS transistors as discussed above.

Figure 3:
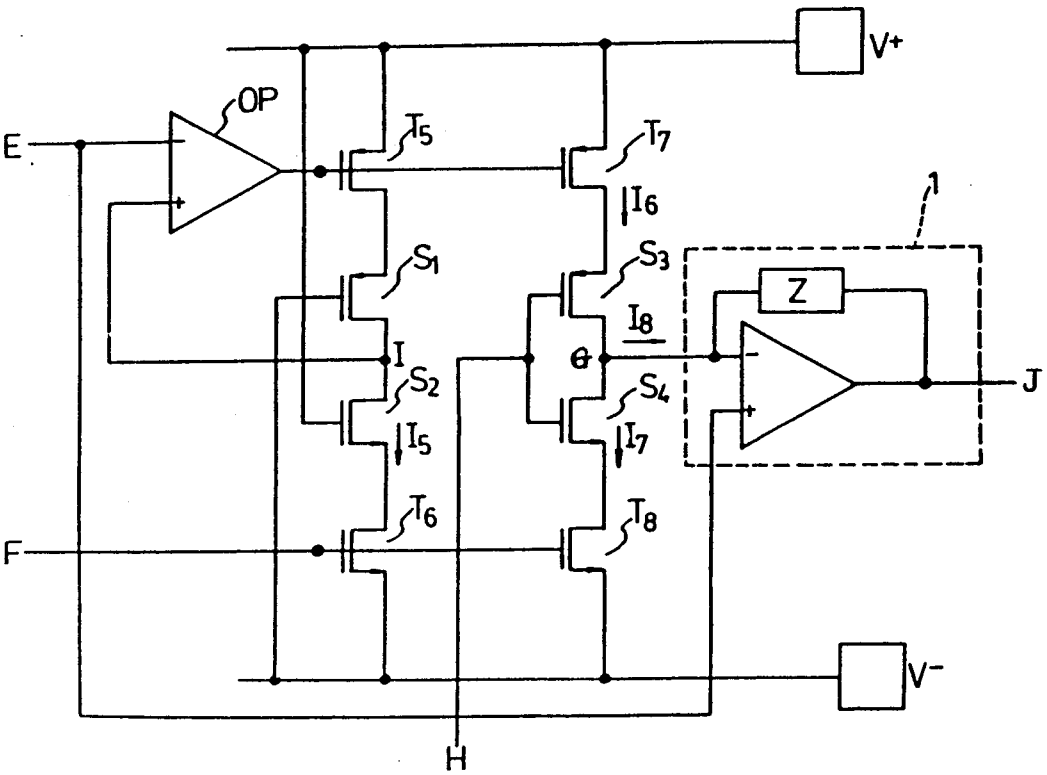
FIG. 3 is a circuit diagram of one embodiment of the present invention.

Referring to FIG. 3, in accordance with a first preferred embodiment of the invention. This circuit differs from that of FIG. 2 only in that S1, S2, S3 and S4 are all MOS transistors. The gate of the transistor employed for the switch S1 is illustrated as connected to the terminal V− and the gate of the transistor employed for the switch S2 is illustrated as connected to the terminal V+, whereby both of the transistors are always conductive. In this circuit:

$$\frac{(W/L)\text{ of }T7}{(W/L)\text{ of }T5} = \frac{(W/L)\text{ of }T8}{(W/L)\text{ of }T6} = \frac{(W/L)\text{ of }S3}{(W/L)\text{ of }S1} = \frac{(W/L)\text{ of }S4}{(W/L)\text{ of }S2} = X$$

When the voltage of node H is V+, the circuit operates in the sinking current mode and the relation −I8=I7=X*I5 is true since Vgs6=Vgs8, Vds6=Vds8, Vgs(S2)=Vgs(S4) and Vds(S2)=Vds(S4). When the voltage of node H is V−, then the circuit operates in the sourcing current mode and the relation I8=I6=X*I5 is true since Vgs5=Vgs7, Vds5=Vds7, Vgs(S1)=Vgs(S3) and Vds(S1)=Vds(S3). Therefore, the circuit provides equivalent source and sink current at the same voltage of node F.

Figure 4:
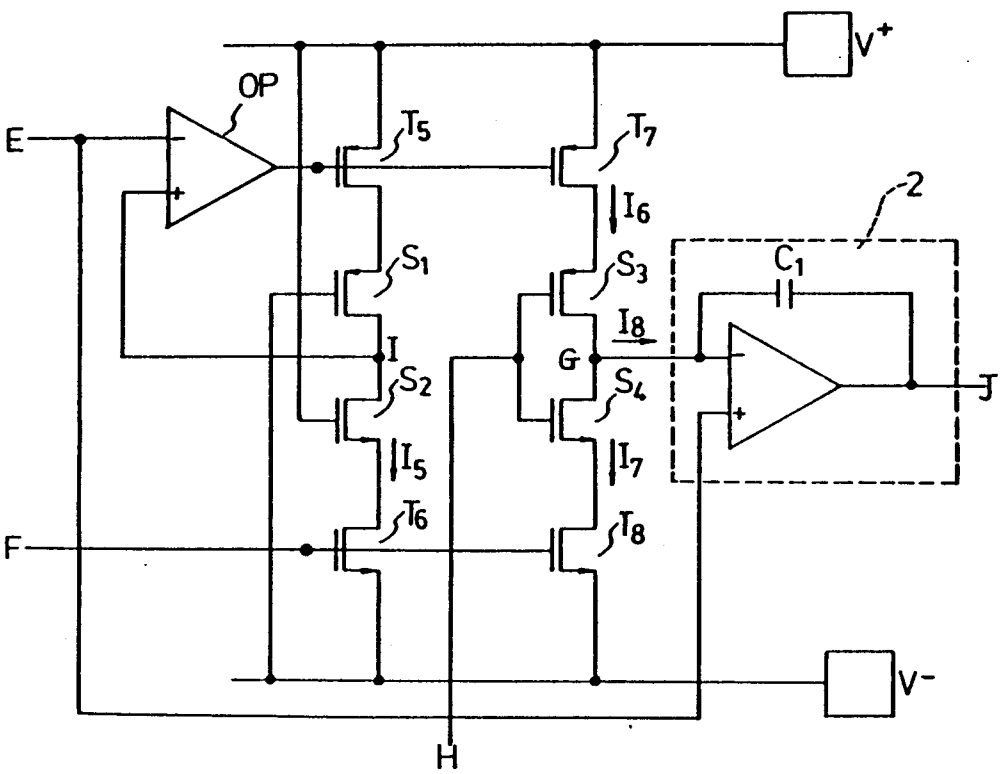
FIG. 4 is a circuit diagram of another embodiment of the present invention.

Referring to FIG. 4, in accordance with another preferred embodiment of the invention, the feedback circuit 1 of FIG. 3 is replaced by integrator 2 as shown. In this circuit, the integrator as illustrated may be comprised of an operational amplifier with a feedback capacitor C1.

Figure 1:
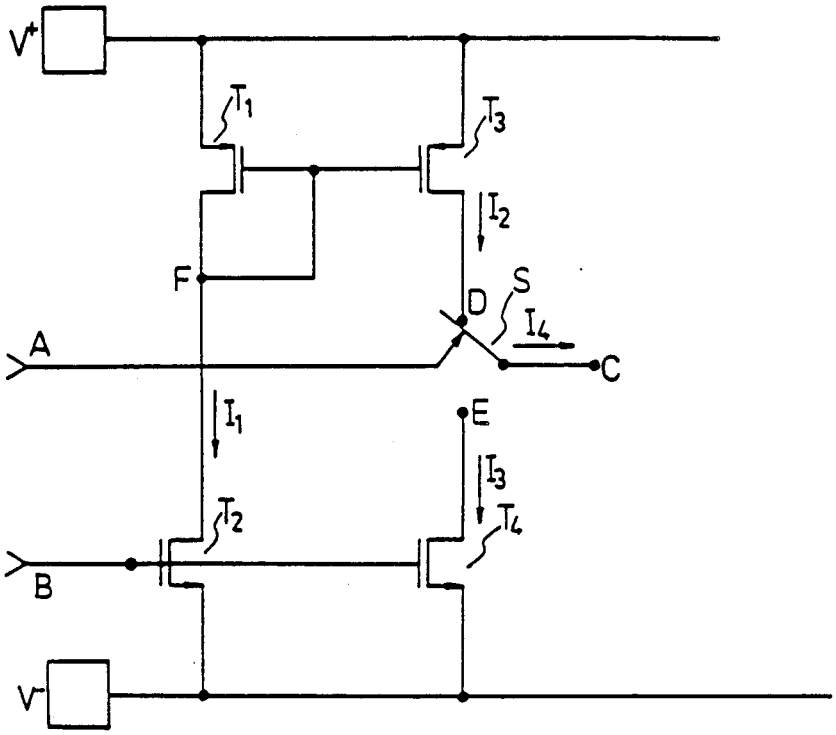
FIG. 1 PRIOR ART
FIG. 1 is a circuit diagram of a prior art current source.
Figure 5:
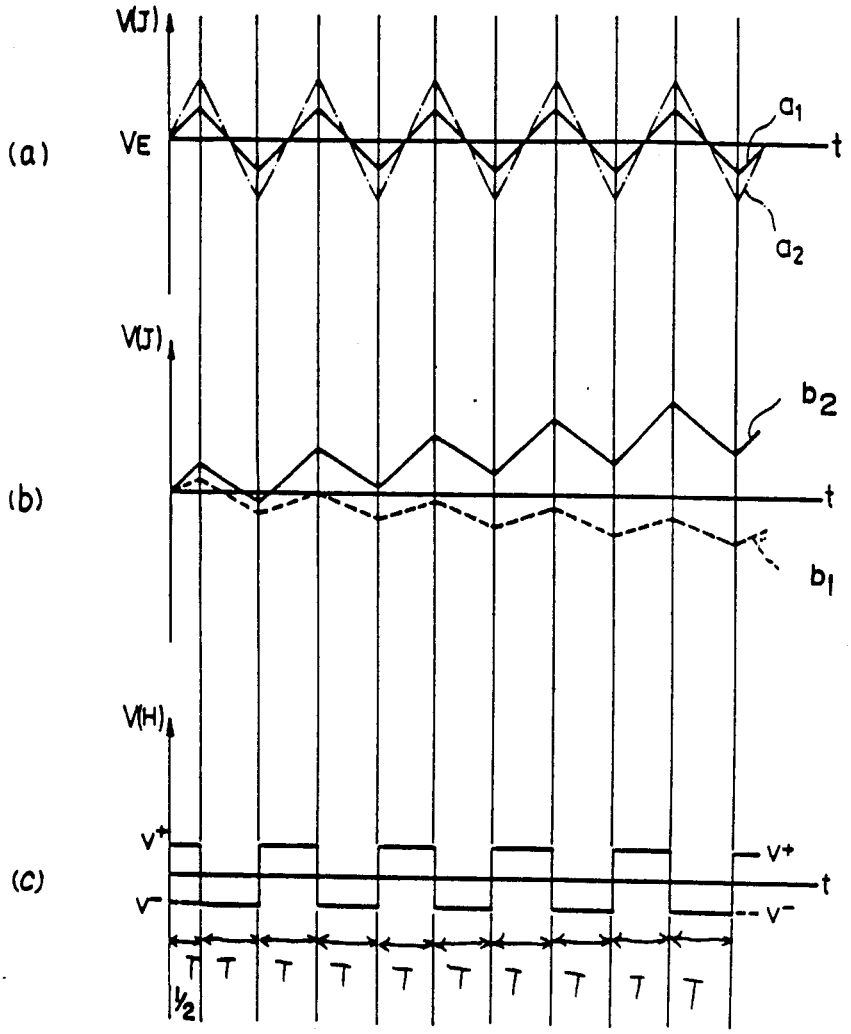
FIG. 5 is the comparison of waveforms of the matching current source of the present invention and prior current source, assuming the connection of the outputs of these circuits to the same integrator.

Assuming V(H) of FIG. 5(*c*) is voltage waveform applied to node H of FIG. 4, initially the voltage across the capacitor C1 is zero. If node F is set at a constant voltage, the voltage waveform of the output J of the integrator is the waveform a1 of FIG. 5(*a*). If node F is set at a different constant voltage, the waveform will change to the waveform a2 of FIG. 5(*a*). The waveforms a1 and a2 both are symmetrical waveforms with respect to V(E), the voltage of node E, since the voltage slope of integrator output dV(J)/dt equals I7/C1 when V(H)=V+ and the voltage slope of integrator output dV(J)/dt equals -I6/C1 when V(H)=V−. If the matching current source of the invention were replaced by the current source in FIG. 1, waveforms a1 and a2 of FIG. 5(*a*) would be expected to change to the waveforms b1 and b2 as shown in FIG. 5(*b*). The waveforms b1 and b2 are not symmetrical to any constant voltage.

While the invention has been disclosed and described with reference to a limited number of embodiments, it will be apparent that many variations and modifications may be made therein, and it is therefore intended in the following claims to cover each such variation and modification as falls within the true spirit and scope of the invention.

What is claimed is:

1. A matching current source circuit for providing equivalent sink and source current comprising:

a first circuit stage comprising a first transistor, a set of dummy switches comprising first and second constantly on switches, and a second transistor, connected in series in that order;

a second circuit stage comprising a third transistor, a set of current switches comprising third and fourth switches, and a fourth transistor, connected in series in that order;

means for selectively setting said third and fourth switches to have a first state with the third switch on and the fourth switch off, and a second state with the third switch off and the fourth switch on;

an operational amplifier having its output coupled to the input electrodes of the first and third transistors;

the noninverting input of the operational amplifier being coupled to the junction between the first and second switches and its inverting input being connected to have the same voltage as the junction point between third and fourth switch;

whereby, depending on the first or second states of said third and fourth switch, the matching current source provides a current sink or source.

2. The matching current source of claim 1 wherein the first and second switches comprise constantly conductive transistors.

3. The matching current source of claim 1 wherein the third and fourth switch comprise first and second transistors which are conductive and nonconductive respectively in said first state and nonconductive and conductive respectively in said second state.

4. The matching current source of claim 1 wherein the operational amplifier and the first circuit stage comprises a unity gain feedback loop.

5. The matching current source of claim 1 wherein the input electrodes of the second and fourth transistors are coupled to a common external voltage source for controlling the amplitude of sink and source current.

6. The matching current source of claim 1 wherein said transistors and switches are all MOS transistors.

7. The matching current source of claim 1 wherein said transistors and switches are all bipolar transistors.

8. A matching current source comprising a first stage comprising a first transistor, a second transistor, and means between said first and second transistors for connecting said first and second transistors in series; a second stage comprising a series connection of a third transistor, switching means, and a fourth transistor, in that order; an output junction, said switching means comprising means for selectively connecting said third and fourth transistors to said output junction; an operational amplifier having an output coupled to the input electrodes of said first and third transistors and a noninverting input coupled to said connecting means; an input terminal coupled to the input electrodes of said second and fourth transistors; an output circuit coupled to said output junction and having an output terminal, said output means comprising means for holding the potential at said output terminal substantially equal to that of the inverting input of said operational amplifier.

9. The matching current source of claim 8 wherein said connecting means comprises fifth and sixth constantly conductive transistors connected in series between said first and second transistors, the junction of said fifth and sixth transistors being coupled to the noninverting input of said operational amplifier, and said switching means comprises seventh and eighth transistors connected between said third and fourth transistors, said output junction being the junction between said seventh and eighth transistors, and further comprising means for selectively controlling said seventh and eighth transistors to have a first state with the seventh transistor conductive and the eighth transistor nonconductive, and a second state with the seventh transistor nonconductive and the eighth transistor conductive, whereby said matching current source is in a sourcing mode in one state of said seventh and eighth transistors and is in a sinking mode in the other of said states.

10. The matching current source of claim 9 wherein said operational amplifier and first stage are interconnected to define a unity gain feedback loop.

11. The matching current source of claim 9 wherein said output circuit comprises a feedback amplifier having an inverting input coupled to said output junction and a noninverting input coupled to the inverting input of said operational amplifier.

12. The matching current source of claim 9 wherein said output circuit comprises an integrating circuit having an amplifier with an inverting input coupled to said output junction and a noninverting input coupled to the inverting input of said operational amplifier.

* * * * *